United States Patent [19]

Patton

[11] 4,421,238

[45] Dec. 20, 1983

[54] SADDLE RACK

[76] Inventor: Suzanne Patton, 8055 Buckingham Rd., Cincinnati, Ohio 45243

[21] Appl. No.: 277,987

[22] Filed: Jun. 26, 1981

[51] Int. Cl.[3] ..... A47F 5/08

[52] U.S. Cl. ..... 211/87; 211/106; 211/13

[58] Field of Search ..... 211/87, 13, 106, 182

[56] References Cited

U.S. PATENT DOCUMENTS

| | | | |
|---|---|---|---|
| 791,107 | 5/1905 | Padden | 211/106 |
| 1,055,488 | 3/1913 | Paterson | 211/87 |
| 2,205,099 | 6/1940 | Lentz | 211/106 X |
| 2,577,473 | 12/1951 | McEwen | 211/106 |
| 3,680,819 | 8/1972 | Meland | 211/106 X |
| 3,977,328 | 8/1976 | Berger | 211/182 |
| 4,078,753 | 3/1978 | Cole | 211/13 X |

*Primary Examiner*—William E. Lyddane
*Assistant Examiner*—Peter A. Aschenbrenner
*Attorney, Agent, or Firm*—Kinney and Schenk

[57] ABSTRACT

A low profile multi-purpose rack for saddles permits storage and transportation of horse saddles in a manner which optimizes the use of storage and transport space. The saddle rack has a base and a retainer which is selectively pivotal with respect to the base. The rack may also be used to pivotally support a saddle in a manner which permits easy access to both the top and under surfaces of the saddle during cleaning.

10 Claims, 5 Drawing Figures

SADDLE RACK

BACKGROUND OF THE INVENTION

The present invention relates generally to racks for saddles and more particularly concerns a space saving multi-purpose rack for securing horse saddles against a planar surface such as a wall or ceiling.

Horse saddles are commonly stored on racks when not in use. These racks securely hold the horse saddles and reduce the chance of damage during periods of nonuse and storage. Most frequently, these racks have a configuration that permits the saddle to rest thereupon in a manner which is similar to the way in which it fits upon a horse. In other words, the saddle is supported with the seat in an upright position with the skirts or stirrups suspendedly hanging therefrom.

In many situations, the above described method of storing or transporting saddles in quite satisfactory. However, at many times space limitations either prohibit storing a saddle in this normal manner or make such a storage arrangement unsatisfactory. One situation in which space limitations make the usual method of storing saddles inconvenient is when saddles are stored or transported in a tack compartment of a horse trailer. Storage and transportation of horse saddles in tack compartments of horse trailers is very common and frequently accompanies transportation of a horse in the same trailer. The size of most tack compartments, however, limits the number of saddles that may be stored or transported. In the past, this limitation has been unduly accentuated by the prior art saddle racks that have been utilized. These prior art saddle racks position the saddle in an upright position as it is normally fitted on a horse, as described above. Consequently, much of the available space in the tack compartment is wasted.

In addition to the manner in which prior art saddle racks orient saddles during storage and transport, it is, in most cases, necessary to lift a saddle over the rack in order to position it in a secure rest position. Thus, additional clearance space (either above or elsewhere) is required in addition to that space needed to secure the saddle in a rest position. When working within the confines of a horse trailer tack department, for example, which provides very limited space, is obviously desirable to limit the additionally required clearance space as much as possible.

It has also been found that the saddle rack of the present invention is highly useful as an aid in cleaning of a saddle. Today, many saddles are cleaned by hanging the saddle from a hook which is secured to a ceiling. The hook is fastened to the stirrup of a saddle with the saddle then hanging downwardly from the attached stirrup. Although awkward, hanging the saddle in this manner generally permits access to both the top and undersides of the saddle. Conventional saddle racks do not generally permit easy access to the under surfaces of the saddle that must be cleaned. The need therefore exists for a saddle rack which would permit easy access to both the top and undersurfaces of a saddle for cleaning purposes.

It is thus an object of the present invention to provide a saddle rack which securely holds a horse saddle in a compact space.

It is another object of the present invention to provide a saddle rack which will securely hold a horse saddle against a planar surface, such as a wall or ceiling, with minimum intrusion into the space perpendicular to that surface.

It is yet another object of the present invention to provide a saddle rack that requires a minimum of extra clearance for placing and removing a saddle from the rack.

It is a further object of the present invention to provide a saddle rack which may be used as an aid in cleaning a horse saddle and which provides easy access to both the top and undersurfaces of the saddle.

SUMMARY OF THE INVENTION

In accordance with the invention, a saddle rack is provided which includes a base with a first centrally disposed portion which extends in a first plane. A second portion of the base extends outwardly from the first portion's extremities in a direction away from the first plane. The base further has end portions extending from the second portions in a direction substantially parallel to the first plane. The end portions are, however, spaced from the first plane. The first centrally disposed portion of the base is adapted for fixation to a planar surface, such as a wall or ceiling, and this first centrally disposed portion has means for securing the base to the planar surface. A retainer member is releasably and securably connectable to the end portions of the base member. The retainer member is spaced from the first plane and extends in substantially the same plane as the end portions of the base member.

In accordance to a further aspect of the invention, the base portion of the rack has end portions which are tubular and receive the ends of the retainer member to securably connect the base and retainer members.

A further aspect of the invention involves the use of a solid rod as the retainer member and a tubular member as the base.

In accordance to yet another aspect to the invention, the first centrally disposed portion of the base has a U-shaped configuration.

A still further feature of the invention involves the use of a retainer member with a U-shaped configuration.

In accordance with still another aspect of the invention, the base of the saddle rack is a first continuous piece of material, and the retainer is a second continuous piece of material.

According to a still further aspect of the invention, the retainer member and the end portions of the base are spaced from the first plane of the first centrally disposed portion of the base by a distance between three and eight inches.

In accordance with yet another aspect of the invention, the end portions of the base of the saddle rack are spaced from each other by a distance between seven and thirteen inches.

In accordance with yet another aspect of the invention, a releasable connection between the retainer and base members is selectively pivotal.

A further aspect of the invention involves the use of a nonabrasive coating on the exterior periphery of the base and retainer members.

In accordance with a further and more specific aspect of the invention, this nonabrasive coating is a plastic material.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE PREFERRED EMBODIMENT

Figure 2:
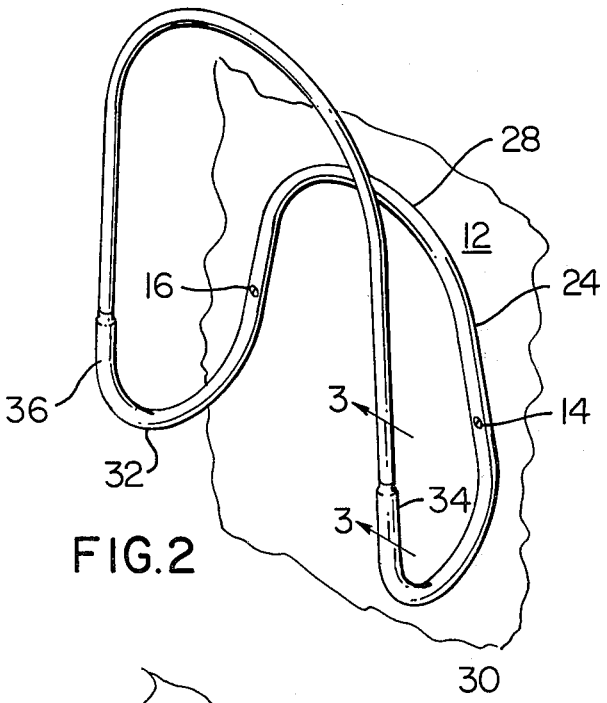
FIG. 2 is a perspective view of the saddle rack of FIG. 1, with the saddle removed, showing the rack secured to a wall.

Referring to the drawings and initially to FIG. 2 in particular, a saddle rack generally designated by the numeral 10 is shown. As illustrated, the saddle rack 10 is securely affixed to a planar surface 12, which, for purposes of the present description, will be described as a vertical wall. In the illustrated embodiment, the rack 10 is secured to the wall 12 through the agency of a plurality of screws 14 and 16 as well as a nonillustrated screw. These screws 14 and 16 extend through apertures 18 and 20 respectively (FIG. 4) of the rack 10 and into the vertical wall 12 while the non-illustrated screw extends through an aperture 22 and into the same vertical wall 12.

Figure 3:
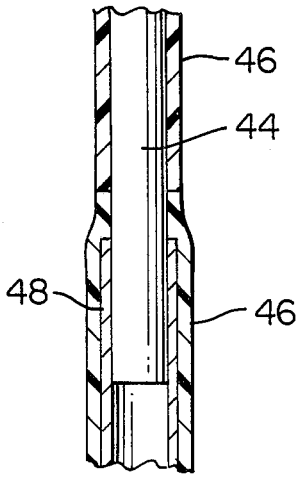
FIG. 3 is a cross-sectional view taken along line 3—3 in FIG. 2 showing a retainer portion of the saddle rack fitting into a base portion of the same saddle rack.

The saddle rack 10 is perhaps most completely illustrated in FIGS. 2 and 3. It is seen that the illustrated rack 10 includes a base component 24 and a retainer component 26. The base component includes a centrally disposed U-shaped portion 28 which lies in a predetermined plane, the plane of the U-shaped portion 28 being substantially parallel to the plane of a wall 12 in FIG. 2. The extremities of the U-shaped planar portion 28 are bent out of the predetermined plane to form cradle portions 30 and 32 extending in a direction away from the wall 12 in FIG. 2. In the preferred embodiment, the cradle portions 30 and 32 are not quite perpendicular to the plane of the U-shaped portion. Instead, these cradle portions 30 and 32 are flared outwardly at a slight angle in a converging fashion so as to increase the spacing between the cradle portions 30 and 32 as these portions extend away from the wall 12.

As the base 24 extends further away from the U-shaped planar portion 28, its end portions undergo a further directional transition with parallel portions 34 and 36 extending from the cradle portions 30 and 32 respectively. These parallel protions 34 and 36 are generally parallel to each other and to the plane defined by the centrally disposed U-shaped portion 28. Because the cradle portions 30 and 32 are flared outwardly slightly as described above, it is possible to have easy axial access to screws 14 and 16 with a screw driver or the like. Apertures 18 and 20, through which screws 14 and 16 extend, are disposed below the vertical (as illustrated) terminus of parallel portions 34 and 36.

Figure 4:
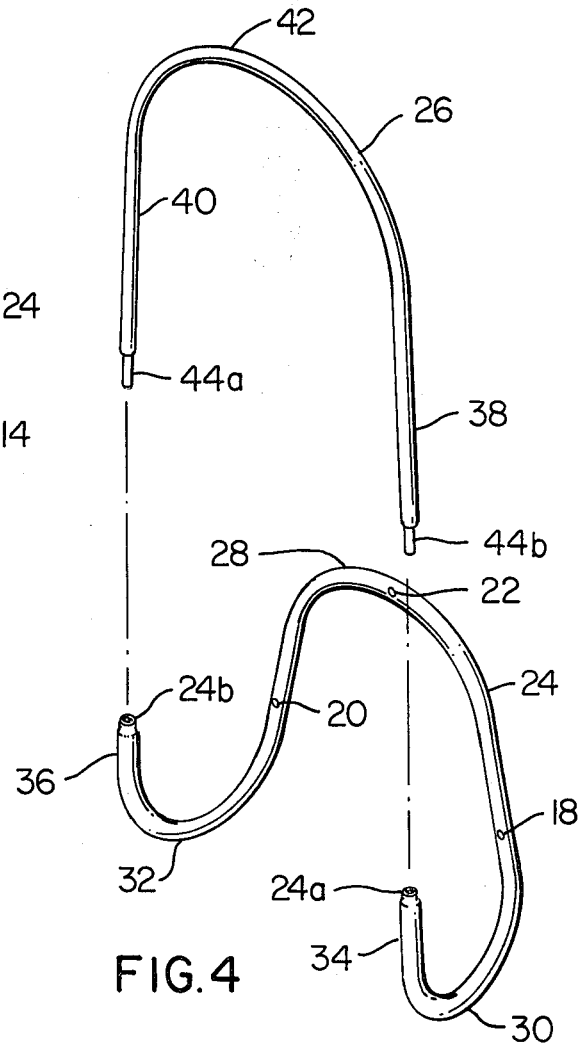
FIG. 4 is an exploded perspective view of the saddle rack illustrated in FIG. 2 depicting the retainer of the rack in detached relationship to the base portion.

FIG. 4 shows that the retainer component 26 also has a U-shaped configuration with generally straight side portions 38 and 40 being joined by a centrally disposed arcuate portion 42. As perhaps best realized from a joint viewing of FIGS. 2 and 4, the retainer component 26 is a solid U-shaped rod 44, preferably formed of steel, with a nonabrasive coating 46 applied to its external periphery. In the preferred embodiment, this nonabrasive coating 46 is a plastic material sold under the trademark Plastisol. However, other types of nonabrasive material, such as fleece or equivalent material, may be used. As seen from the depiction of FIG. 4, the free ends 44*a* and 44*b* of the U-shaped steel rod 44 are not coated with the nonabrasive material 46.

The base component 24, like the retainer component 26, is coated on its external periphery by the nonabrasive plastic material 46. However, unlike the retainer component 26, the base component 24 is formed of a hollow steel tubing 48. In the preferred embodiment, this tubing is formed of steel and is ½ inch in diameter. The solid retainer rod 44 is ⅜ inch in diameter so as to be cooperatively interactable with the base tubing. Thus, the free ends 24*a* and 24*b* of the base 24 receive the free ends 44*b* and 44*a* respectively of the retainer component 26. FIG. 3 shows one of these free retaining ends 44*a* or 44*b* being received by one of the free base ends 24*a* or 24*b*.

Figure 1:
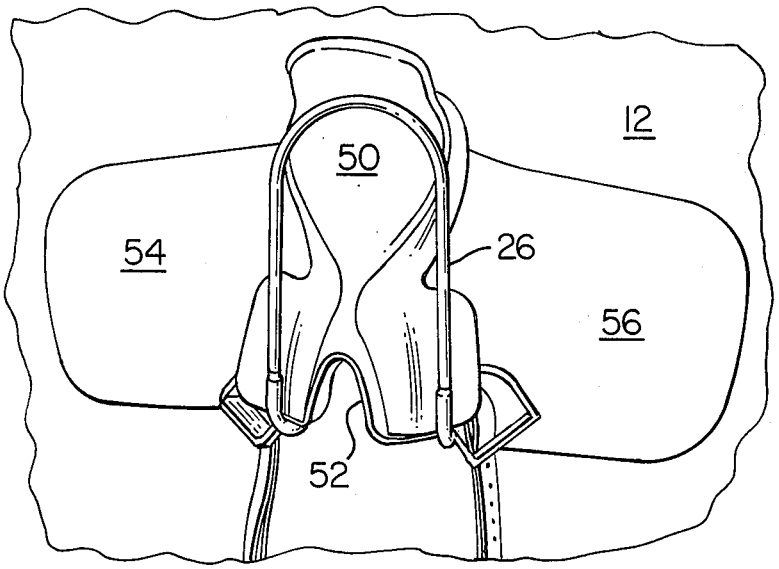
FIG. 1 is a perspective view of the saddle rack constructed in accordance to the present invention showing a saddle being held in close proximity to a wall.

FIG. 1 shows a cut-back or flat saddle 50 being secured by the saddle rack 10 in close proximity to the wall 12. The retainer 26 supports the seat portion of the saddle 50 and prevents horizontal movement of the saddle 50. The arcuate portion 42 of the retainer 26 is depicted as being in contacting relationship with the seat portion of the saddle 50. The cradle portions 30 and 32 support the predominance of the saddle's weight. It is seen that these cradle portions 30 and 32 engage the front end of the saddle 50 adjacent the prommel 52. Applicant has found that in order to effectively support horse saddles, the cradle portions 30 and 32 must be spaced by a distance approximately between 7 and 13 inches, 10½ inches being preferable. Similarly, it has been found that the parallel portions 34 and 36 and the retainer 26 should be spaced from the U-shaped portion of the base by a distance between 3 inches and 8 inches, preferably by a distance of approximately 4¾ inches.

When supported upon the illustrated saddle rack, the skirts 54 and 56 of the saddle 50 are extended in generally parallel relationship to the wall 12. In this manner, the outward protrusion from the wall 12 is minimized and the saddle is safely and securely hung on the wall 12. This arrangement still permits air to flow about the underside of the saddle 50 most proximal to the wall, allowing any moisture or perspiration on the underside of the saddle to evaporate.

Figure 5:
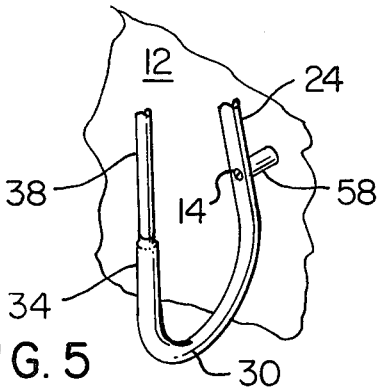
FIG. 5 is a fragmentary perspective view of a saddle rack similar to that depicted in FIG. 2 but being secured to a wall through a spacer element.

FIG. 5 shows a slight modification in the manner in which the base portion 24 is secured to the wall 12. Instead of applying the U-shaped portion 28 of the base component 24 flatly against the wall 12, spacers 58 are used. Only one spacer 58 is shown in registry with aperture 18 for receiving screw 14. However, similar, but nonillustrated, spacers are aligned with apertures 20 and 22. These spacers position the rack a slight distance (determined by the length of spacers 58) from the wall 12 to accommodate a knee roll saddle.

The saddle rack of the preferred embodiment is also highly useful as a ceiling rack. When used as a ceiling rack, the base portion of the rack is secured to a ceiling in the same manner as to wall 12 in the illustrated embodiment. When used as a ceiling rack, it is generally preferable to use further retainer elements to support the weight of the saddle skirts and to minimize intrusion of those skirts into the space perpendicular to the ceiling. As will be readily apparent to those skilled in the art, by securing the saddle rack 50 to a ceiling in a limited space, as for example in a tack compartment of a horse trailer, much of the previously unutilized space beneath the saddle may be used for other saddles or other equipment.

It will be further appreciated by those skilled in the art that the present invention requires but minimal clearance for the saddle above that which is required to support the saddle and the rack in a rest position. This is because the retainer element is detachable from the base element. When used, the base element 24 may, for example, be attached to a vertical wall. With the retainer 26 detached, a saddle 50 is securely rested upon the cradle portions 30 and 32. After the saddle is rested on the cradle portions 30 and 32, the retainer element 26 is connected to the base portion 24 to further secure the saddle 50. It is thus seen that, unlike many prior art saddle racks, it is not necessary to lift the saddle 50 over the retainer element 26 to secure the saddle 50 in the rack 10. A consequence of this feature is that the saddle rack may be positioned more closely to a ceiling, for example, than a prior art rack. Furthermore, since very little clearance is needed to place the saddle in its storage position, it may be positioned higher on a vertical wall without exceeding the vertical reach of a user.

Because of the manner in which the retainer component 26 is joined to the base component 24, the rack 10 may be advantageously used to clean the saddle 50. Applicant has found that one of the free end connections between the base and the retainer components 24 and 26 may be disconnected while leaving the other connection connected. The retainer 26 is then pivotally movable with respect to the base component 24 about this connecting connection. The pommel 52 of the saddle 50 is then rested upon one of the cradle portions 30 or 32 with the center of the underside of the saddle resting against the retainer portions 38 or 40. The saddle may then be pivoted about the pivoted junction between the base and the retainer components for easy access to both the top and underside surfaces of the saddle 50. In many instances, the top of the saddle may be cleaned while the saddle is in its normal storage position.

Although not shown in the illustrated embodiment, applicant has also found that hooks may be advantageously attached to the cradle portions 30 and 32 and used to support or hand other horse riding accessories, such as bridles. Preferably, when the rack 10 is secured to a vertical wall, as in the illustrated embodiment, a hook is secured to the bottom of each of the cradle portions 30 and 32. These hooks form a cradle which is similar to, but disposed beneath, the cradle formed by the cradle elements 30 and 32.

Thus, it is apparent that there has been provided, in accordance with the invention, an apparatus that fully satisfies the objects, aims, and advantages set forth above. While the invention has been described in conjunction with a specific embodiment thereof, it is evident that many alternatives, modification, and variations will be apparent to those skilled in the art in light of the foregoing description. Accordingly, it is intended to embrace all such alternatives, modifications, and variations as fall within the spirit and broad scope of the appended claims.

What is claimed is:

1. A saddle rack for storing a saddle in a limited space, said rack comprising:

a U-shaped base member, said member having a first centrally disposed portion forming a first plane, said first centrally disposed portion having means for securly mounting said U-shaped base member to a planar surface, said centrally disposed first portion having two U-shaped hook like portions extending outwardly and away from said plane of said first centrally disposed portion, said two U-shaped hook like portions forming planes perpendicular to said plane of said first centrally disposed first portion, said two U-shaped hook like portions having end portions extending from each in a direction substantially parallel to said plane of said first centrally disposed portion of said base member and spaced therefrom; and a U-shaped retainer member, said member being releaseably but securably connected to said end portion of said U-shaped hook portion of said base member, said retainer member forming a plane substantially parallel to said plane of said centrally disposed portion of said base member when releasably but securably connected to said U-shaped hook like portions of said base member, the closed portion of said U-shaped retainer member extending beyond the closed portion of said U-shaped centrally disposed portion of said base member, said U-shaped retainer member being substantially parallel to said U-shaped centrally disposed portion of said base member and spaced therefrom.

2. A saddle rack as recited in claim 1 wherein the end portions of said base member are tubular and receive the ends of the said retainer member together to securely but releasabily connect the base and retainer members.

3. A saddle rack as recited in claim 2 wherein said retainer member is a solid rod and said base member is tubular.

4. A saddle rack as recited in claim 3 wherein the base is a first continuous piece of material and the retainer is a second continuous piece of material.

5. A saddle rack as recited in claim 4 wherein said retainer member and said two end portions of said base member are spaced from said first plane of said first centrally disposed U-shaped portion of said base by a distance between three and eight inches.

6. A saddle rack as recited in claim 5 wherein said two end portions of said base are spaced from each other by a distance between seven and thirteen inches.

7. A saddle rack as recited in claim 2 wherein said securely but releasable connection between said retainer members and said base members is selectively pivotal.

8. A saddle rack as recited in claim 7, wherein said retainer members and said base members are formed of a metal.

9. A saddle rack as recited in claim 7 wherein the extension peripheries of said base member and said retainer member are coated with a nonabrasive coating.

10. A saddle rack as recited in claim 9 wherein the nonabrasive coating is a plastic material.

* * * * *